US007729474B2

(12) United States Patent
Ito et al.

(10) Patent No.: US 7,729,474 B2
(45) Date of Patent: Jun. 1, 2010

(54) X-RAY GENERATOR USING HEMIMORPHIC CRYSTAL

(75) Inventors: Yoshiaki Ito, Uji (JP); Shinzo Yoshikado, Kyotanabe (JP); Toru Nakamura, Kyoto (JP); Yoshikazu Nakanishi, 3-18, Kojogaoka, Otsu-shi, Shiga 520-0821 (JP)

(73) Assignees: Kyoto University, Kyoto (JP); The Doshisha, Kyoto (JP); Asahi Roentgen Ind. Co., Ltd., Kyoto (JP); Yoshikazu Nakanishi, Shiga (JP)

( * ) Notice: Subject to any disclaimer, the term of this patent is extended or adjusted under 35 U.S.C. 154(b) by 210 days.

(21) Appl. No.: 11/887,515

(22) PCT Filed: Jan. 27, 2006

(86) PCT No.: PCT/JP2006/301322

§ 371 (c)(1),
(2), (4) Date: Sep. 27, 2007

(87) PCT Pub. No.: WO2006/103822

PCT Pub. Date: Oct. 5, 2006

(65) Prior Publication Data

US 2009/0041194 A1 Feb. 12, 2009

(30) Foreign Application Priority Data

Mar. 29, 2005 (JP) ..... 2005-094742

(51) Int. Cl.
*G21G 4/00* (2006.01)
*H01J 35/00* (2006.01)

(52) U.S. Cl. ..... 378/119

(58) Field of Classification Search ..... 378/119, 378/121, 122, 136, 141; 250/423 R, 424, 250/426, 427, 493.1
See application file for complete search history.

(56) References Cited

U.S. PATENT DOCUMENTS 3,840,748 A 10/1974 Braunlich (Continued)

FOREIGN PATENT DOCUMENTS

JP 63-085004 4/1988

(Continued)

OTHER PUBLICATIONS

*X-Ray Fluoresced High-Z (Up to Z=82) K X Rays Produced by $LiNbO_3$ and $LiTaO_3$ Pyroelectric Crystal Electron Accelerators*, Brownridge, et al., Applied Physics Letters, vol. 85, No. 7, Aug. 16, 2004, pp. 1298-1300.

(Continued)

*Primary Examiner*—Edward J Glick
*Assistant Examiner*—Mona M Sanei
(74) *Attorney, Agent, or Firm*—Kirschstein, et al.

(57) ABSTRACT

An X-ray generator uses a high electrical field generated when a hemimorphic crystal is heated or cooled. The crystal may be lithium niobate polarized in one direction. An X-ray target is placed inside a housing inside which a vacuum is maintained. A tungsten line containing thorium is placed between the crystal and the target. When the crystal is heated or cooled by a Pelletier element, an intense electrical field is generated around the crystal. Thermoelectrons released from the tungsten line accelerate as a result of the electrical field and collide with the X-ray target. The X-rays released at this time radiate through a beryllium window exteriorly of the housing. Intense X-rays are generated without using large scale equipment, such as a high voltage power source.

4 Claims, 4 Drawing Sheets

U.S. PATENT DOCUMENTS

| | | | | |
|---|---|---|---|---|
| 2003/0215052 | A1* | 11/2003 | Grodzins | 378/19 |
| 2007/0165784 | A1* | 7/2007 | Nakanishi et al. | 378/119 |
| 2008/0156634 | A1* | 7/2008 | Ito et al. | 204/176 |

FOREIGN PATENT DOCUMENTS

| | | | |
|---|---|---|---|
| JP | 2005-174556 | | 6/2005 |
| JP | 2005174556 | A * | 6/2005 |
| JP | 2005-281081 | | 10/2005 |
| JP | 2005-285575 | | 10/2005 |

OTHER PUBLICATIONS

*Investigations of Pyroelectric Generation of X Rays*, Brownridge, et al., Journal of Applied Physics, vol. 86, No. 1, Jul. 1, 1999, pp. 640-647.

* cited by examiner

X-RAY GENERATOR USING HEMIMORPHIC CRYSTAL

TECHNICAL FIELD

The present invention relates to an X-ray generator using a high electrical field generated by a hemimorphic crystal, and in particular, provides an X-ray generator which can generate intense X-rays without requiring large scale equipment, such as a high voltage power source.

BACKGROUND ART

The present inventors invented an apparatus where a hemimorphic crystal, such as a lithium niobate ($LiNbO_3$) single crystal, is contained within a housing having low gas pressure, and the temperature of this crystal is periodically changed so that electrons which are generated on the surface of the crystal because they cannot follow the offset of the charge on the surface collide with an X-ray target or the hemimorphic crystal using a high electrical field generated by the crystal, and thus, X-rays are generated (Japanese Laid-Open Patent Publication No. 2005-174556), and furthermore, invented an apparatus where a pair or pairs of such hemimorphic crystals are placed so as to face each other, so that an X-ray target is efficiently irradiated with electrons generated on the surface of the crystals while the electrons multiply, and thus, more intense X-rays are generated (Japanese Laid-Open Patent Publication No. 2005-285575).

In terms of the intensity of the X-rays generated according to the invention, the larger the amount of electrons separated from the crystal when the temperature of the hemimorphic crystal is changed and released into the housing is, the more intense the gained X-rays are, but there is a restriction, such that the temperature for heating the hemimorphic crystal must be the Curie point or lower, and thus, the range in terms of the change in the temperature of the crystal is limited, and therefore, it is difficult to greatly increase the amount of electrons and charged particles separated from the crystal. That is to say, in terms of the technical background, it can be said that the intensity of the generated X-rays is limited, to a certain degree, by the size of the crystal and the temperature range for heating and cooling.

The present inventors focused on the electron acceleration function resulting from the high electrical field generated by a hemimorphic crystal, and conducted a research in order to overcome the problem of the amount of electrons separated and released from the crystal being limited, and as a result, proposed an idea: that a greater number of electrons be made to accelerate so as to collide with an X-ray target using the high electrical field by providing an apparatus for positively supplying electrons, that is to say, an electron generator (electron supplier), in the vicinity of the crystal so that more intense, continuous X-rays and characteristic X-rays can be gained in accordance with the purpose, by appropriately controlling the density of electron radiation using this electron generator.

(Patent Document 1) Japanese Laid-Open Patent Publication No. 2005-174556

(Patent Document 2) Japanese Laid-Open Patent Publication No. 2005-285575

DISCLOSURE OF THE INVENTION

The present invention provides, as a means for achieving the above-described object, an X-ray generator, comprising: a housing having low gas pressure; a hemimorphic crystal arranged within the housing and polarized in one direction; an electron generator arranged separately from the hemimorphic crystal within the housing for generating and radiating thermoelectrons; a metal target spaced from the hemimorphic crystal for generating X-rays; and a heater for changing a temperature of the hemimorphic crystal and generating a high electrical field in the housing so that the thermoelectrons radiated by the electron generator accelerate and collide with the metal target due to the high electrical field, to produce the X-rays for discharge from the housing.

According to a preferred embodiment of the present invention, the X-ray generator further comprises a hollow electrode, for example, a hollow cathode tube, arranged in a periphery of the space between the hemimorphic crystal and the metal target for generating X-rays so that a high electrical field (lines of electric force) generated by the hemimorphic crystal converge and are directed toward the metal target by this hollow cathode, and thermoelectrons generated within the housing are accelerated and converged toward the metal target.

According to another preferred embodiment of the present invention, the heater is a temperature cycle generating stage made of a Peltier element, where the Peltier element is placed on a rear surface of the crystal, that is to say, on a surface on a side opposite to a surface facing the metal target so as to periodically heat and cool the hemimorphic crystal.

According to further preferred embodiment of the present invention, the X-ray generator further comprises means for controlling a density of thermoelectrons released from the electron generator based on a change in the temperature of the hemimorphic crystal.

Here, although it is preferable for the electron generator, which is a main portion according to the present invention, to be placed in a middle portion, between the crystal and the metal target within the housing having low gas pressure, it is desirable, in the case where the system includes a means for generating high temperatures, for example a thermoelectron source, for the electron generator to be placed in the vicinity of the periphery portion above the housing so that the heat radiated from this means for generating high temperatures can be prevented from being conveyed to the crystal as much as possible.

Furthermore, in the case where a heat shield wall formed of a heat resistant heat insulating material or the like intervenes between this thermoelectron source and the crystal, the effects of radiated heat on the hemimorphic crystal can be substantially avoided. In this case, as a measure against thermoelectrons generated by the electron generator, it is desirable to create an appropriate electron permeable hole or a gap in the heat shield wall so that thermoelectrons are effectively released toward a center portion of the housing.

As described above, according to the present invention, intense X-rays can be generated in a compact and simple device, without requiring any large scale equipment, such as a high voltage power source apparatus, and therefore, a portable high power X-ray generator which can be easily and widely used in the medical field, including in clinics, as well as analysis and examination institutions, and other industries of various types can be provided.

In addition, a compact and convenient X-ray generator for generating ozone which can be used efficiently for pasteurization and sterilization in restaurants and hotels can be provided, and thus, the industrial and commercial value of the present invention when applied is extremely great.

EXPLANATION OF NUMERALS

Figure 1:
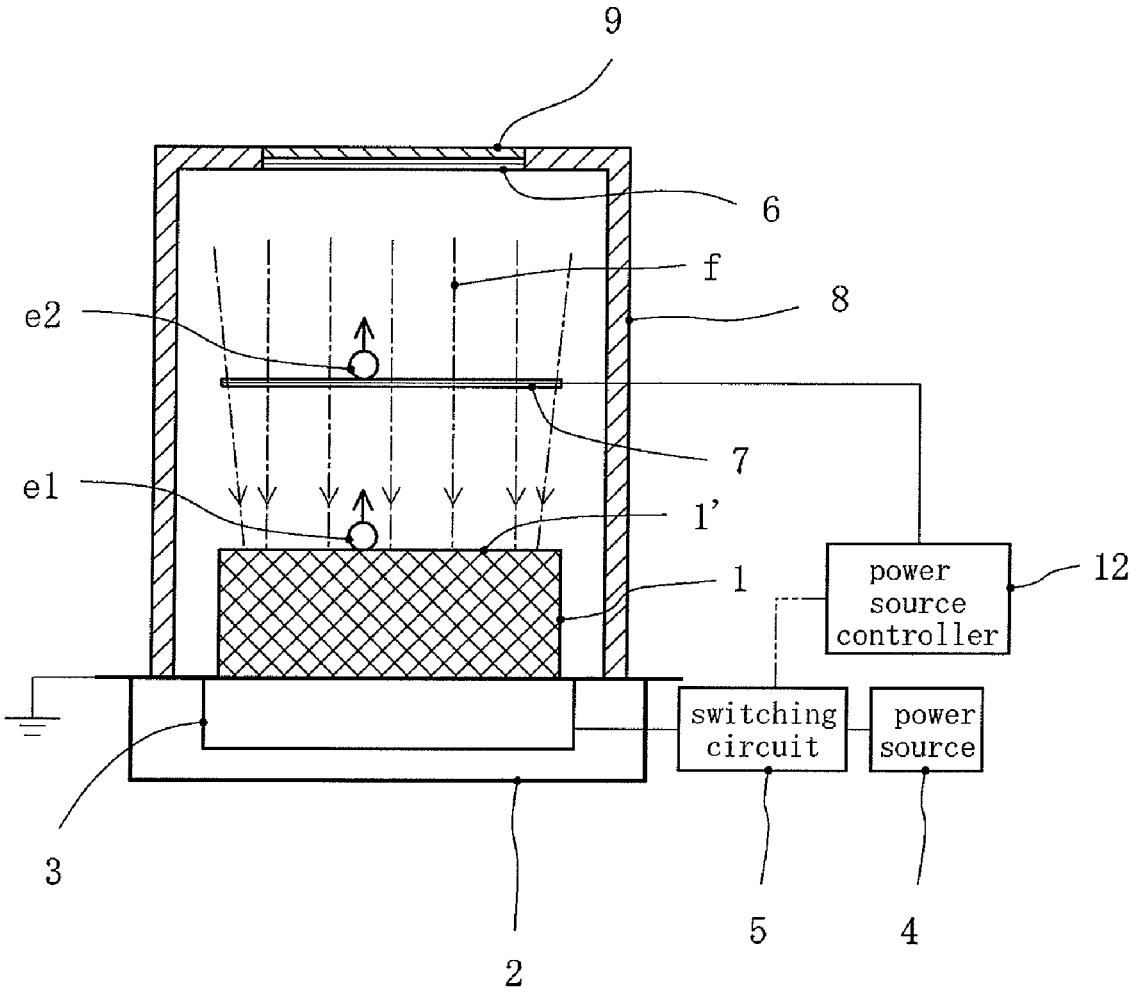
FIGS. 1 to 3 are conceptual diagrams showing different embodiments of the present invention, and longitudinal cross sectional diagrams showing the relationship in the arrangement of a hemimorphic crystal, an electron generator, an X-ray target and other members within a housing having low gas pressure.

1 hemimorphic crystal
1' surface of hemimorphic crystal facing X-ray target
2 mechanism for changing temperature of hemimorphic crystal
3 Peltier effect element
4 power source for energizing Peltier effect element
5 switching circuit for potential for energizing Peltier effect element
6 X-ray target
7, 7', 7" electron generator
8 housing surrounding low pressure gas (housing having low gas pressure)
9 X-ray permeable window
10 hollow cathode tube
11 active layer
12 power source controller for electron generator
13 heat shield wall
14 electron permeable hole provided in heat shield wall

BEST MODE FOR CARRYING OUT THE INVENTION

In the following, the embodiments of the present invention are described in reference to the drawings.

FIG. 1 is a conceptual diagram illustrating a representative embodiment of the present invention, where a reference numeral 1 designates a hemimorphic crystal, for example of lithium niobate ($LiNbO_3$), also referred to as pyroelectric crystal, and although crystals of different dimensions and thicknesses can be used, a crystal having an area of 110 $mm^2$ and a thickness of 5 mm is used in the present embodiment. A reference numeral 2 designates a heat cycle stage for periodically changing the temperature of the hemimorphic crystal, and is formed of a Peltier effect element 3, a power source 4 for energizing this, and a switching circuit 5 for periodically reversing a polarization of a voltage for energizing the element. At the heating stage, a lower surface of the crystal makes contact with the surface for heating of the Peltier effect element 3, and therefore, the exothermic energy is conveyed directly to the lower surface of the crystal 1 so that the crystal is rapidly heated. In the next cycle, the voltage for energizing the element is switched to the opposite polarization, and therefore, the lower surface of the crystal becomes the surface for absorbing heat from the element, and thus, the crystal is cooled to a temperature close to room temperature. That is to say, this stage controls the timing for heating and cooling the crystal.

In addition, the hemimorphic crystal used according to the present invention is a pyroelectric crystal where the direction of polarization inside the crystal is uniform in one direction so as to be parallel to the generated high electrical field. The direction of polarization of the crystal is uniform in one direction throughout the entirety of the crystal (poling), and thus, a high polarization voltage is gained, and therefore, a higher electrical field can be generated around the crystal without failure, by changing the temperature as described above. It is possible for the direction of polarization to be uniform as a result of an operation when the crystal grows, and in addition, this is also possible as a result of an electrical process on the crystal.

In this embodiment, a hemimorphic crystal where the direction of polarization is uniform, as described above, is installed so that the negative surface (minus surface) of the polarization of the main axis faces the target.

In the figure, a reference numeral 6 designates an X-ray target, and usually a metal body, such as of tungsten (W) or copper (Cu), and a reference numeral 7 designates an electron generator placed in the space between this target 6 and the surface 1' of the crystal 1, that is to say, an electron supplier for releasing thermoelectrons, and these form the main portion of the present invention.

In the example in the figure, the electron source 7 uses a tungsten line having a diameter of approximately 0.1 mm to 1 mm and containing thorium, and a voltage of approximately 100 V is applied to the tungsten line so that thermoelectrons are released. A reference numeral 12 designates a controller for supplying a current to the electron source.

The electron generator 7, the crystal 1 and the X-ray target 6 are arranged inside a highly air-tight housing 8 in cylindrical form which is formed of an X-ray shield material, such as stainless steel in the state shown in the figure, and an inside of the housing is kept a vacuum of approximately $10^{-3}$ Pa. Here, a reference numeral 9 designates a window for taking out X-rays and made of an X-ray permeable material, such as beryllium.

The operation for X-ray generation in the above-described embodiment is described in the following.

A voltage is applied to the Peltier element 3 so that the temperature of the heat emitting surface (upper surface) becomes approximately 100° C. to 250° C., and using this heat energy, the hemimorphic crystal 1 is heated to a high temperature of 100° C. or higher. Next, the polarization switching circuit 5 is switched so that an upper surface of the element 3 is switched to an endothermic side. As a result, the temperature of the hemimorphic crystal 1 rapidly drops to approximately room temperature. This heating and cooling operation is repeated with a period of approximately 3 minutes to 15 minutes through an appropriate control circuit or a CPU, and thus, the temperature of the hemimorphic crystal 1 is periodically changed from a temperature of no lower than 100° C. to room temperature.

As a result, as the present inventors clarified in the previous patent application (Japanese Laid-Open Patent Publication No. 2005-174556), the change in the polarization voltage inside the crystal cannot follow the change in the temperature, and therefore, neutralization of charge on the surface of the crystal is ceased, and an intense electrical field is generated around the crystal (in particular, an intense electrical field is generated when the crystal is in the cooling process).

That is to say, lines of intense electric force are generated, as shown by dotted lines f in the figure, and an intense electric field created by these lines accelerates electrons e1 and charged particle separated from the crystal so that they collide with the X-ray target 6, and thus, continuous X-rays and characteristic X-rays specific to the target material are generated by the target through braking radiation.

According to the present embodiment, the high electrical field f generated around the hemimorphic crystal 1 is used more effectively, so that a greater number of electrons are directed toward the target, and a thermoelectron source 7 is placed in the space above the crystal so that thermoelectrons e2 are positively released from the thermoelectron source into a vacuum housing, and these thermoelectrons accelerate as a result of the electrical field f together with electrons e1 separated from the crystal, so as to be directed toward the target, and thus, more intense X-ray energy can be successfully extracted.

In this case, the electron generator 7 is formed of a filament, and may be provided so as to stretch over the space between the crystal 1 and the target 6, as shown in FIG. 1, or a number of filaments may be placed from a bottom to a top within the housing 8 so as to be parallel or have different angles from one another, and may form coils, spirals or a mesh. In order to efficiently accelerate thermoelectrons from the electron generator, it is desirable for the inside of the housing to be a vacuum with an air pressure of approximately $10^{-3}$ Pa or lower, and when the electron generator 7 is placed in a location close to the target, the efficiency of X-ray conversion becomes high.

In addition, sufficient energy for acceleration can be gained as a result of the high electrical field generated by the crystal, and therefore, sufficient efficiency of X-ray conversion can be gained only by setting a potential of the X-ray target to the ground potential or a potential which is slightly plus relative to the electron generator or the crystal, and therefore, it is not necessary to apply a potential as high as for conventional X-ray targets, and no high voltage power source equipment is necessary.

In addition, although in this embodiment, the heat cycle stage 3 for changing the temperature of the crystal is provided outside the vacuum housing, it is also possible for it to be mounted in a low pressure atmosphere inside the housing through an airtight mechanism, as shown in the next embodiment.

Figure 2:
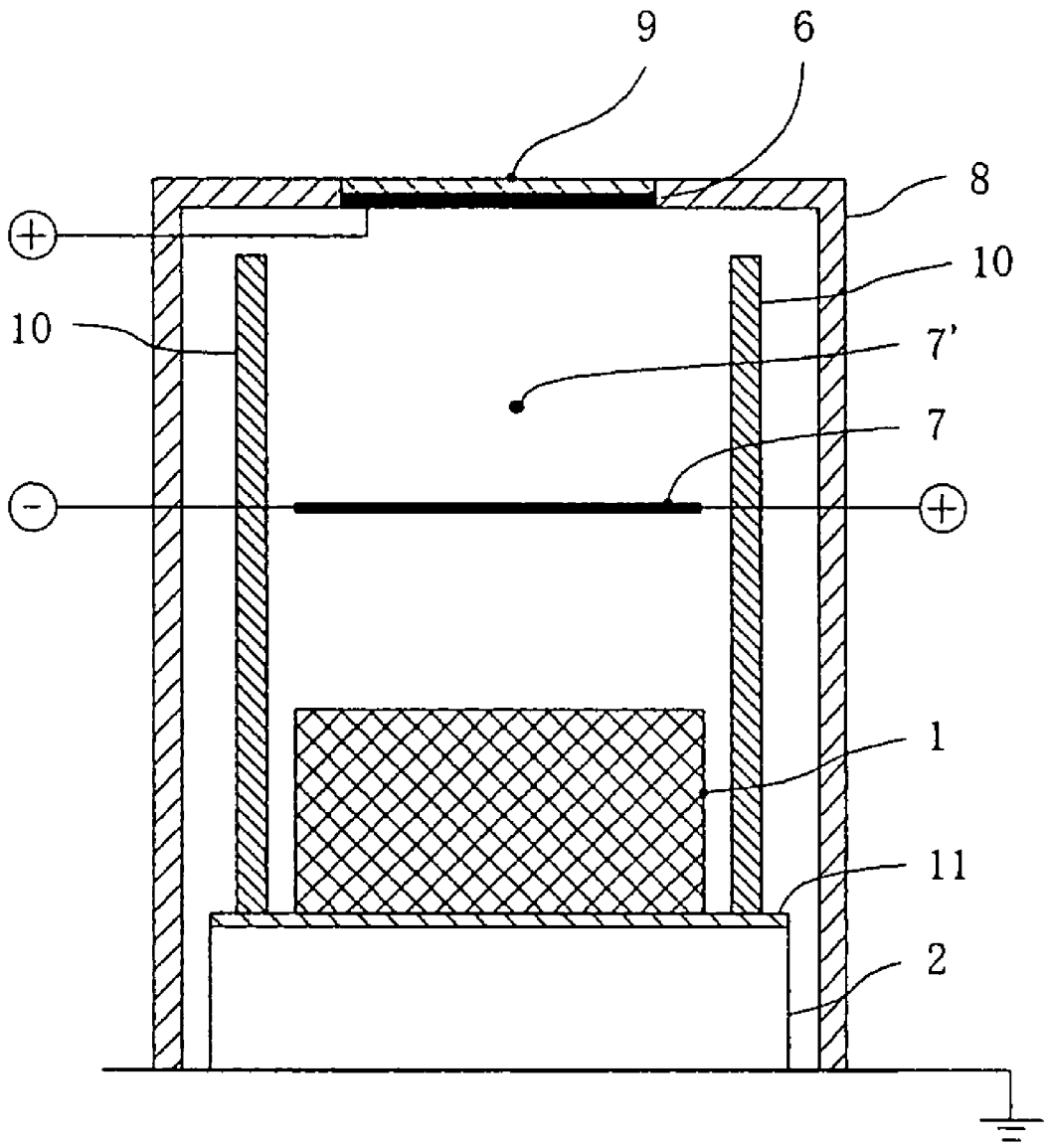

FIG. 2 shows another embodiment of the present invention, which is an example where a hollow electrode is provided around the space between the X-ray target 6 and the hemimorphic crystal 1 in the example of FIG. 1, and an example where a hollow cathode tube 10 in cylindrical form made of graphite (insulator), for example, is placed.

That is to say, lines of electric force (single dot chain line) resulting from the intense electrical field generated by the hemimorphic crystal are effectively directed toward the target by means of this hollow cathode tube 10, so that a function of making thermoelectrons radiated from the electron generator 7 converge toward the X-ray target 6 is gained.

In addition, a part of the electrons released from the crystal and the electron generator collides with this hollow cathode tube 10 and other electrons are secondarily released from these, and thus, a state where the density of electrons within the housing is higher is gained, so that the electrons are effectively directed toward the target along the high electrical field generated around the crystal, and therefore, the efficiency of X-ray conversion increases, and this effect is synergetic with the increase in the density of electrons, making it possible to extract more intense X-rays. Here, numerals which are the same in other figures show the same members and the same effects as in FIG. 1.

In this embodiment, upper and lower electron generators 7 and 7' are provided in two stages, and one electron generator 7' is provided in a direction perpendicular to a paper surface, and in addition, an active layer 11 intervenes between a lower surface of the hemimorphic crystal 1 and the heat cycle stage 3 so that electrons and charged particles are also released from this active layer 11 as a result of the high electrical field, due to a thermal excitation of the hemimorphic crystal, and these, combined, contribute to a generation of X-rays. A thin film having a low work function, such as of a magnesium oxide (MgO) or a calcium oxide (CaO), is appropriate for this active layer.

Figure 3:
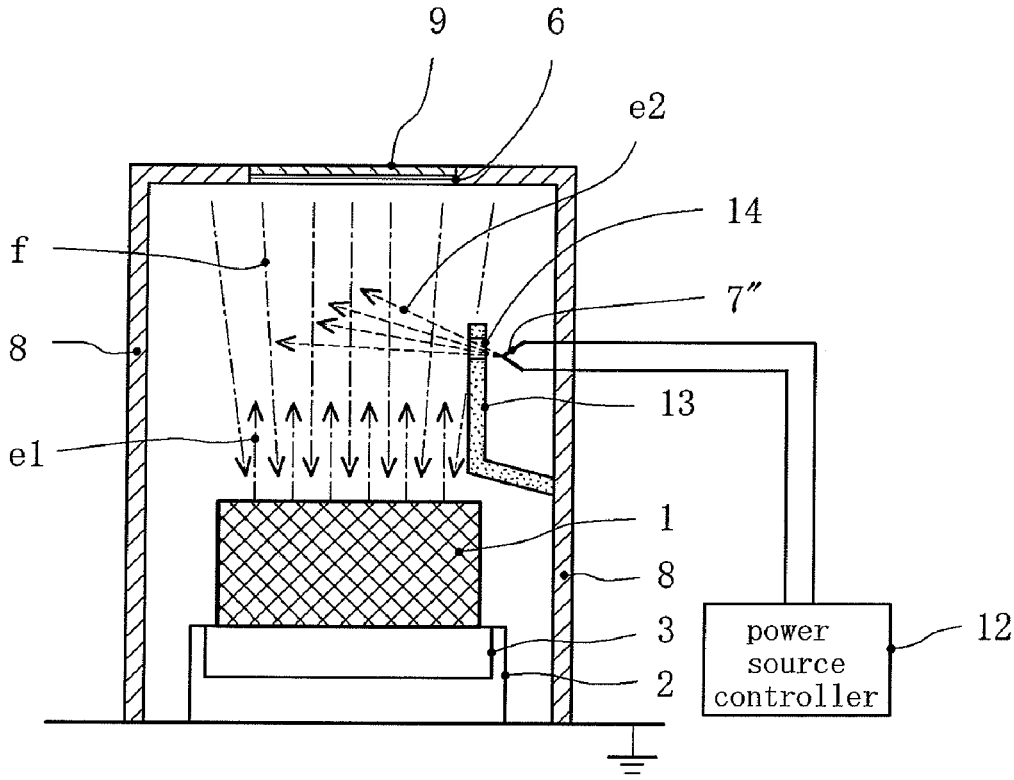

FIG. 3 shows an example where the electron generator is placed to a side of an upper portion of the hemimorphic crystal 1, as shown by 7" in the figure, which is an example where an arrangement of the electron generator 7" is taken into consideration so that the amount of heat radiated from the electron generator 7" which is conveyed to the hemimorphic crystal 1 becomes as small as possible.

As described above, according to the present invention, the high electrical field generated by the crystal when the temperature of the hemimorphic crystal is changed (heat cycle excitation) is used so that free electrons released into the housing accelerate and are directed toward the X-ray target, and therefore, the temperature of the hemimorphic crystal, that is to say, the results of the control for heating the crystal, significantly affect the generated high electrical field.

Therefore, in the case of a thermoelectron source, it is desirable for the heat energy generated by this thermoelectron source to affect the crystal as little as possible.

In FIG. 3, the electron source is placed in a location to the side of the crystal and at a distance from the crystal, and it has been confirmed that the effects of heat radiated from the electron source on the crystal is greatly reduced.

A reference numeral 13 designates a heat shield wall for blocking conveyance of radiated heat to the crystal, formed of a heat resistant heat insulating member, and installed in the heat conveyance path between the electron source 7" and the crystal 1 so as to block heat from the electron source.

Here, thermoelectrons generated by the electron generator 7" can be effectively released to the center portion of the housing by providing an appropriate gap through which electrons can pass, for example by providing an electron permeable hole 14 in the heat shield wall 13.

As described above, even when a thermoelectron source is provided, the effects of heat on the crystal can be sufficiently suppressed by providing a heat shield wall, and thus, the temperature for control of the crystal, that is to say, a function of generating a high electrical field, is not lost.

Here, other numerals in the figure indicate the same parts as in FIGS. 1 and 2.

Figure 4:
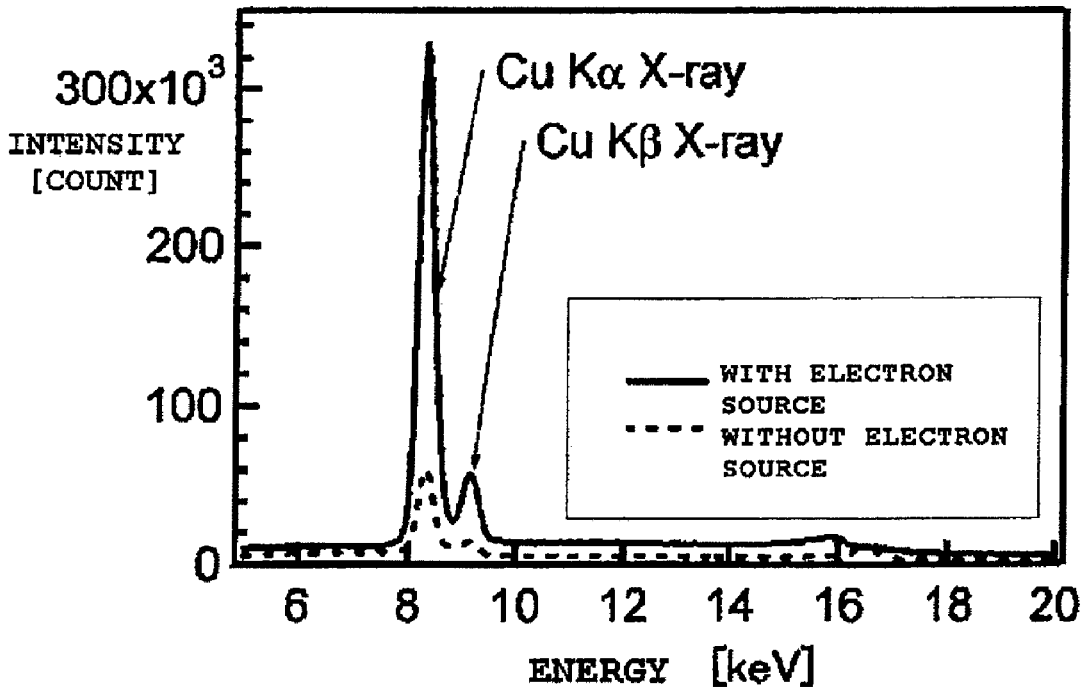
FIG. 4 is a graph showing the measured intensity of extracted X-rays in the embodiment shown in FIG. 3 together with the measured intensity of X-rays in the case where no thermoelectrons are generated within the housing.

FIG. 4 is a graph showing the measured intensity of extracted X-rays in the embodiment shown in FIG. 3 together with the measured intensity of X-rays in the case where no thermoelectrons are generated within the housing, The experiment example shown in FIG. 4 is an example where an $LiNbO_3$ single crystal in which a direction of spontaneous polarization is uniform in a Z direction, which is a square type crystal (of which the surface is polished to a mirror surface) having dimensions of 13 mm×13 mm and a thickness of 5 mm was used as the hemimorphic crystal 1, and a highly pure copper foil having a thickness of 3 μm was installed in an upper portion of the housing 8 as the X-ray target 6 in such a manner that a distance between the target and an upper surface of the crystal became approximately 20 mm, and a tungsten filament was placed to a side of the middle portion between the two as the electron generator 7", and thermoelectrons were released into the housing by making a current for heating (2 V, 3 A) flow through this tungsten filament, and a curve of Cu Kα X-rays shows the intensity of characteristic X-rays Kα of copper and a curve of Cu Kβ X-rays shows the intensity of characteristic X-rays Kβ of copper.

Here, the crystal 1 was heated to 120° C. over approximately 16 minutes, and after that, cooled to room temperature (approximately 10° C.) over approximately 16 minutes, and the X-rays generated by the X-ray target 6 during this cooling process were measured by an X-ray detector using a silicon semiconductor (X-RAY DETECTOR. XR-100CR, made by AMPTEK Inc., United States), as shown in the graph. In addition, a pressure within the housing was kept at $4\times10^{-3}$ Pa.

A dotted line in the graph of FIG. 4 is a curve in the case where no electrons are generated at all by blocking the current to the electron generator 7", and the peak thereof shows the characteristic X-rays Kα of copper.

A longitudinal axis in the graph of FIG. 4 indicates the intensity (number of counts) of the extracted X-rays, and a lateral axis indicates the energy of the X-rays (KeV).

As can be seen from the graph of FIG. 4, the intensity of X-rays in the case where no additional electrons were released (case where only electrons released from the crystal were used) was 40,000 counts to 50,000 counts, while in the case where thermoelectrons were released from the electron source 7", intense characteristic X-rays of 320,000 counts to 330,000 counts could be extracted.

Here, although in the above-described experiment example, a heat shield wall 13 was adopted, in the case where the location of the electron source is further at a distance from the crystal or in the case where an electron source having less heat emission is used, it is not particularly necessary to provide such a heat shield wall.

In addition, in the case where it is desired for X-rays having different energy, such as white X-rays or other characteristic X-rays, to be extracted, it is, of course, necessary to select an X-ray target which corresponds to the purpose.

As described above, it was proven that intensive X-rays can be extracted when an electron generator is provided within the housing.

(Description of Modification)

Although in the above-described embodiment, a tungsten line is illustrated as the electron generator, other appropriate electron suppliers and apparatuses for releasing electrons can be used.

In addition, although an example where $LiNbO_3$ is used as the hemimorphic crystal is described, various types of pyroelectric crystals, such as lithium tantalate ($LiTaO_3$), glycine sulfate (TGS) and barium titanate ($BaTiO_3$), can be used for the hemimorphic crystal, and the same effects can be gained when an appropriate temperature for heating and cooling is selected in accordance with the physical properties of the respective crystals and an appropriate period is selected for the temperature cycle.

In addition, it was clarified that the intensity of the high electrical field generated through the change in the temperature of the crystal, as described above, relates to a thickness of the crystal in a direction parallel to the direction of polarization in such a manner that the thicker the crystal is, the more intense the electrical field becomes, and therefore, an appropriate thickness and dimensions can be selected for the crystal in accordance with an application and a size of the apparatus, as well as polarization properties of the crystal, although it is necessary for the polarization properties within the crystal to be uniform in one direction.

When changing the temperature, it is desirable to set the temperature for heating to the Curie point of the crystal or lower.

In addition, as a means for changing the temperature, that is to say, as a means for creating imbalance in the charge on the surface of the crystal, a combination of a heater line, a high frequency heating means, high output laser generated plasma or other pyro elements and a means for refluxing a coolant, or various other means for changing the temperature in cycles can be used instead of a Peltier effect element.

An appropriate target material may be selected in accordance with the properties and application of the X-rays to be extracted as the X-ray target, and in the case where characteristics are extracted for X-ray analysis, for example, a metal thin plate (Al, Mg, Cu or the like) which is appropriate for a purpose of this analysis may be used. Unlike conventional vessel systems, the present invention is characterized in that the effects of white X-rays are considerably small, and therefore, it is possible to efficiently extract a target element.

In addition, this X-ray target is placed in a location to a side of the housing so that X-rays can be extracted from a side wall surface of the housing.

In general, when a hemimorphic crystal is heated, a first side of the surface of the crystal is charged positive and a second side is charged negative, while when cooled, the surface of the crystal is charged so that these polarities are the opposite. That is to say, the polarity of the potential on the surface facing the electron source of the crystal is reversed between a period when the crystal is in a heating cycle and the period when the crystal is in a cooling cycle. Accordingly, when the upper surface of the crystal is charged to a positive potential (for example in the period when the crystal is in a heating process), a part of the released electrons is attracted to the hemimorphic crystal and collides with it so that X-rays are generated. These X-rays hit the target and contribute to a generation of secondary X-rays.

Meanwhile, when the upper surface of the crystal is at a negative potential (for example in the period when the crystal is in a cooling process or the temperature is dropping), the separated electrons are repelled by the negative potential on the surface of the crystal, and all electrons accelerate toward the target and hit the target so as to be converted to X-rays.

Accordingly, in the case where it is desired for the X-rays generated through the collision of electrons released into the housing with the hemimorphic crystal to be reduced and a majority of the generated electrons to be directed toward the X-ray target, the length of the cycle in the change in the temperature should be adjusted so that the heating cycle becomes shorter (rapid heating) and the cooling cycle becomes longer (slow cooling), or measures should be taken to restrict or block the application of a current to the electron generator when the crystal is in a heating process, thereby temporarily restricting the release of electrons. This operation is more effective when it is controlled in conjunction with the operation of the heating and cooling switching circuit in the stage for creating a temperature cycle (see for example double dot chain line between the switching circuit 5 and the controller 12 in FIG. 1).

By doing so, the generation of X-rays by the hemimorphic crystal can be suppressed, so that only X-rays in accordance with the purpose are extracted from the target in large amounts.

Although an example where the hollow cathode tube is formed of graphite is described, other appropriate materials, such as Cu, No and W, can be used in accordance with the state of a high electrical field resulting from the hemimorphic crystal.

Furthermore, an appropriate form can be selected for the hollow electrode, in order to effectively direct and make electrons converge toward the target, and thus, it is also possible to improve a function as an electron lens, that is to say, a function of making electrons converge toward the target.

Although an example where electrons released mainly from an electron generator converge toward an X-ray target as a result of a high electrical field resulting from one hemimorphic crystal is described in the above, more intense X-ray energy can be extracted in the case where a number of hemimorphic crystals and electron generators are placed so as to face the X-ray target so that electrons released from the respective electron generators accelerate as a result of a complex high electrical field generated by the crystals and are effectively directed toward the target or the hemimorphic crystals.

The invention claimed is:

1. An X-ray generator, comprising:

a housing having low gas pressure;

a hemimorphic crystal arranged within the housing and polarized in one direction;

an electron generator arranged separately from the hemimorphic crystal within the housing, for generating and radiating thermoelectrons;

a metal target spaced from the hemimorphic crystal for generating X-rays; and a heater for changing a temperature of the hemimorphic crystal and generating a high electrical field in the housing so that the thermoelectrons radiated by the electron generator accelerate and collide with the metal target due to the high electrical field, to produce the X-rays for discharge from the housing.

2. The X-ray generator according to claim 1, and further comprising a hollow electrode arranged in a periphery of a space between the hemimorphic crystal and the metal target, for generating the X-rays so that lines of electric flux generated by the hemimorphic crystal are directed toward the metal target by the hollow electrode, and the thermoelectrons radiated from the electron generator accelerate and converge toward the metal target.

3. The X-ray generator according to claim 1, wherein the heater is a temperature cycle generating stage made of a Peltier element, and the temperature cycle generating stage is placed on a surface of the hemimorphic crystal on a side opposite to a surface facing the metal target so as to periodically heat and cool the hemimorphic crystal.

4. The X-ray generator according to claim 1, further comprising means for controlling a density of the thermoelectrons radiated from the electron generator based on a change in the temperature of the hemimorphic crystal.

* * * * *